US008398465B2

(12) United States Patent
Hoeschele et al.

(10) Patent No.: US 8,398,465 B2
(45) Date of Patent: Mar. 19, 2013

(54) DUST-PROTECTED HAND-HELD POWER TOOL

(75) Inventors: Volker Hoeschele, Frickenhausen (DE); Heinrich Sikora, Nuertingen (DE)

(73) Assignee: Metabowerke GmbH, Nuertingen (DE)

( * ) Notice: Subject to any disclaimer, the term of this patent is extended or adjusted under 35 U.S.C. 154(b) by 237 days.

(21) Appl. No.: 12/735,617

(22) PCT Filed: Jan. 29, 2009

(86) PCT No.: PCT/EP2009/000569

§ 371 (c)(1),
(2), (4) Date: Aug. 3, 2010

(87) PCT Pub. No.: WO2009/100821

PCT Pub. Date: Aug. 20, 2009

(65) Prior Publication Data

US 2010/0323593 A1 Dec. 23, 2010

(30) Foreign Application Priority Data

Feb. 15, 2008 (DE) ..... 10 2008 009 277

(51) Int. Cl.
*B24B 55/00* (2006.01)

(52) U.S. Cl. ..... 451/359; 451/454; 451/449; 451/488

(58) Field of Classification Search ..... 451/448, 451/449, 451–454, 536–539, 488; 55/509
See application file for complete search history.

(56) References Cited

U.S. PATENT DOCUMENTS

| | | | | |
|---|---|---|---|---|
| 2,550,319 | A | 4/1951 | Wright | |
| 6,527,630 | B2 * | 3/2003 | Mannsperger et al. | 451/344 |
| 2004/0224621 | A1 * | 11/2004 | Fraser et al. | 451/359 |

FOREIGN PATENT DOCUMENTS

| | | |
|---|---|---|
| DE | 944 976 | 6/1956 |
| DE | 1 030 443 | 5/1958 |
| DE | 35 46 394 | 7/1987 |
| DE | 42 38 564 | 5/1994 |
| EP | 0 425 492 | 11/1993 |
| EP | 1 178 559 | 2/2002 |

OTHER PUBLICATIONS

English language translation of German Patentschrift No. 944976 to Csaki issued Jun. 28, 1956.

* cited by examiner

*Primary Examiner* — Dung Van Nguyen
(74) *Attorney, Agent, or Firm* — GrayRobinson, P.A.

(57) ABSTRACT

A battery-operated hand-held power tool (2), especially an angle grinder, comprises a housing base (4) accommodating the electromotive drive components and air inlet openings (10) supplying the electromotive drive components with a cooling air flow. In order to protect the electromotive components from dirt, the hand-held power tool is designed in such a manner that a filter element (20) is provided in the area of the air inlet openings (10) and keeps dust, especially magnetizable dust, away from the electromotive drive components. The filter element (20) is retained by a filter retaining part (12, 30) which can be attached to the exterior of the housing base (4). The filter retaining part (14, 30) can be elastically deformed to such an extent that it is slightly deformed, especially expanded, when attached to the housing base, and engages behind or snaps into an element on the housing base.

8 Claims, 2 Drawing Sheets

DUST-PROTECTED HAND-HELD POWER TOOL

CROSS-REFERENCE TO RELATED APPLICATIONS

This application is the national stage of PCT/EP2009/000569 filed on Jan. 29, 2009 and claims Paris Convention Priority to DE 10 2008 009 277.0 filed Feb. 15, 2008.

BACKGROUND OF THE INVENTION

The invention relates to an open-circuit-ventilated hand-held power tool, in particular, powered by rechargeable batteries, comprising a housing base accommodating the electromotive drive components, and having air inlet openings supplying the electromotive drive components with a cooling air flow. In particular, the invention relates to hand-held power tools, in which the electromotive drive components comprise permanent magnets.

Hand-held power tools usually require air cooling, which is why air inlet openings are provided in the region of the electromotive drive, through which a cooling air flow is formed over the electromotive drive components. Especially in the case of hand-held power tools for metalworking, in particular, cutting and grinding, such as is performed using angle grinders, the problem arises that, with the cooling air flow, magnetizable dust penetrates into the interior of the hand-held power tools and is deposited on the electromotive components, in particular, on the permanent magnets of the electric motor and is near impossible to remove because of its magnetic adhesion. This can result in considerable damage to the electromotive drive components.

The object of this invention is to solve this problem in a simple and economically viable manner.

SUMMARY OF THE INVENTION

This task is inventively solved in a hand-held power tool of this type in that a filter element is provided in the area of the air inlet openings by means of which dust, especially magnetizable dust, can be kept away from the electromotive drive components, the filter element is retained by a filter retaining part that can be attached to the exterior of the housing base, the filter retaining part can be elastically deformed to such an extent that it is slightly deformed, especially expanded, when attached to the housing base, and engages behind or snaps into an engagement element on the housing base.

By disposition of a filter element, in particular, a paper filter, particulate and, in particular, corrosive magnetizable dust can be retained.

In a further embodiment of the invention, the filter element or the filter retaining part is provided in such a way that the air inlet openings are essentially covered over their entire surface from outside by the filter element. This facilitates sealing toward the interior and ensures easier replacement of the filter element. To ensure an effective and powerful cooling air flow, the filter element must also be easy to clean or replace, which is simpler if the filter element is positioned on the exterior of the housing base.

According to a further embodiment of the invention, the filter retaining part on the housing base is pivotably attached to the exterior. This has the advantage of captive mounting of the filter retaining part on the housing base. The filter retaining part therefore forms a sort of holding means to hold the filter element in the region of the air inlet openings on the housing base.

Because the filter retaining part can be snapped onto the housing base and engages behind an engagement element on the housing base, the filter retaining part can be simply and quickly mounted in its intended position on the housing base of the hand-held power tool, for example, when the filter element is replaced.

Because the filter retaining part can be elastically deformed, the snap-on operation can be performed simply. The filter retaining part is simply manually pressed into its intended position. The filter retaining part then slides around the contour of the housing base, wherein it, for example, expands slightly and then snaps into a stable position. To remove or open the filter retaining part, the user can slide the filter retaining part off again in the opposite direction by effecting slight elastic expansion.

In a further embodiment of the invention, the filter retaining part can be constituted as a shell shape with openings. The shell shape then largely matches the outer contour of the housing base. In this way, the filter retaining part can be very flat and be positioned compactly on the housing base of the hand-held power tool. In this case, it is even possible for the filter retaining part to be provided in the region intended for manual holding of the hand-held power tools.

According to a further embodiment of the invention, the filter retaining part, as seen in a longitudinal direction of the housing base of the handheld power tool and in cross-section, is approximately constituted in the shape of a circular arc with a circumferential length of preferably a little more than 180°.

Further characteristics, details, and advantages can be derived from the appended claims and from the drawings and the following description of preferred embodiments of the inventive hand-held power tool.

DESCRIPTION OF PREFERRED EMBODIMENTS

Figure 1A:
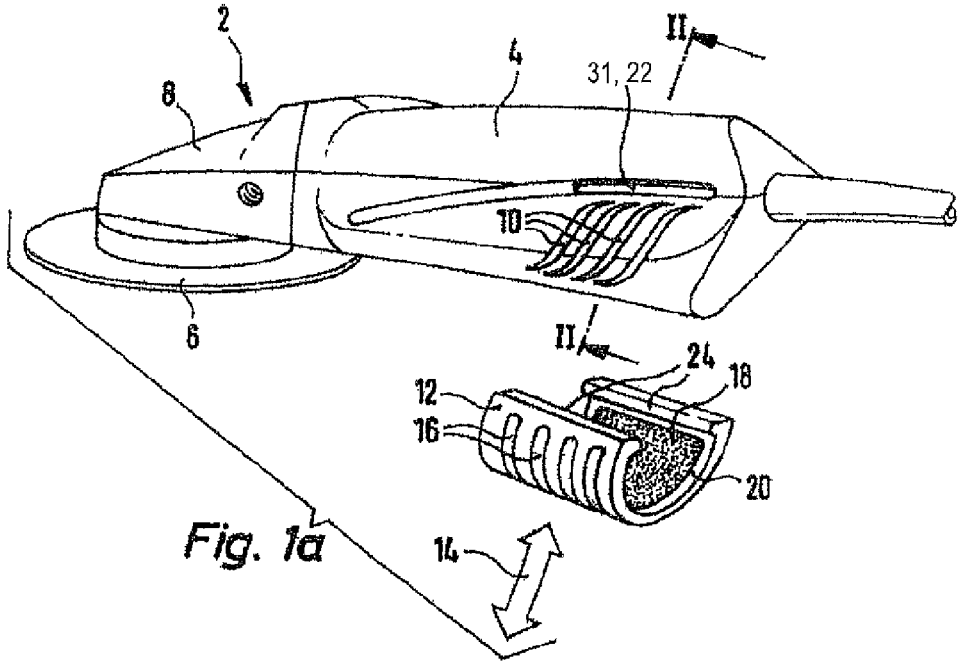
FIG. 1*a* is a first perspective view of a first embodiment of the inventive hand-held power tool.
Figure 1B:
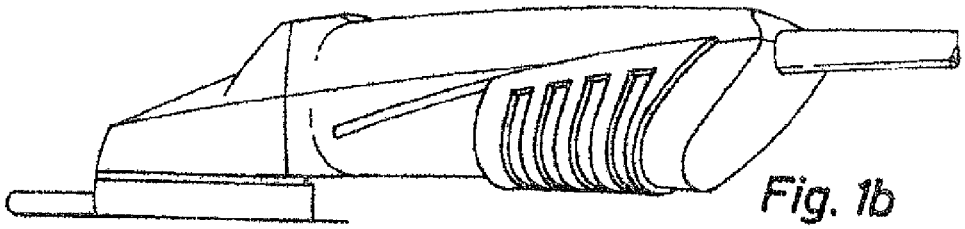
FIG. 1*b* is a second perspective view of the embodiment of FIG. 1*a;*

FIGS. 1*a* and 1*b* show a hand-held power tool 2 in the form of an angle grinder with a housing base 4 accommodating the electromotive drive components and also constituting the handle part of the hand-held power tool 2. This housing base 4 comprises two plastic housing halves located one against the other in a longitudinal division plane. A typically metallic transmission housing part 8 adjoins the housing base 4 in the direction of the tool 6. In a central to rear region of the housing base 4, air inlet openings 10 are provided through which a cooling air flow is formed that cools the electromotive drive components in the interior of the housing base 4 during operation of the hand-held power tool 2. The cooling air flow suctioned into the interior of the housing base 4 through these air inlet openings 10 is blown out again at a different position, typically in the region of the transition to the transmission housing part 8.

Figure 2:
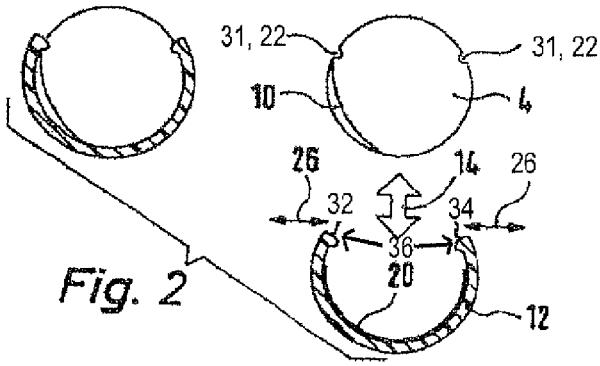
FIG. 2 consists of two schematic sectional views with intersecting plane II-II of FIG. 1*a* to illustrate the position of a filter retaining part.

In the region of the section of the housing base 4 comprising the air inlet openings 10, a filter retaining part 12 is snapped onto the housing base 4 from below and outside in the direction of the arrow 14. The filter retaining part 12 is constituted in the shape of a half shell and adapted to the outer contour of the housing base 4 in this region. It also has elongated openings 16. As shown in FIG. 2, the filter retaining part 12 is of arcuate cross section which terminates in a first end 32 and a second end 34 which are spaced a distance 36 from one another. A filter element 20, in the simplest case, a sheet of a paper filter, can be positioned against the inside 18 of the filter retaining part 12 facing the housing base 4. This paper filter element then covers the air inlet openings 10 in the housing base 4 from outside and retains, in particular, corrosive magnetizable dust. FIG. 1*a* further shows on the outer side of the housing base 4 above the air inlet openings 10 an engagement element 31 in the form of a slot-shaped rounded recess 22, into which the filter retaining part 12 with an approximately complementarily constituted elongated engagement lug 24 can snap. This ensures that the filter retaining part 12 is stably retained on the housing base 4 while remaining removable due to its elastically compliant properties. FIG. 2 is a schematic sectional view showing how the filter retaining part 12 is snapped onto the housing base 4 in the direction of the arrow 14. Therein, the free first and second ends 32, 34 of the filter retaining part 12 are slightly expanded (see double arrow 26, which shows the elastic compliance of the filter retaining part 12).

Moreover, the filter retaining part 12 can also constitute the filter element or incorporate it as an integral component. For example, it is conceivable for the filter retaining part 12 to comprise a glued-on or molded-on plastic or metal sieve or similar filter component as an integral component in the region of its openings 16.

Figure 4:
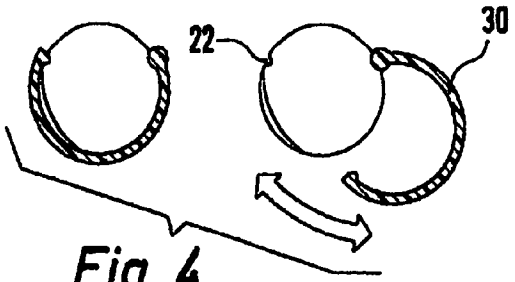
FIG. 4 consists of two schematic sectional views with intersecting plane IV-IV of FIG. 3*a* to illustrate the position of a filter retaining part.
Figure 3C:
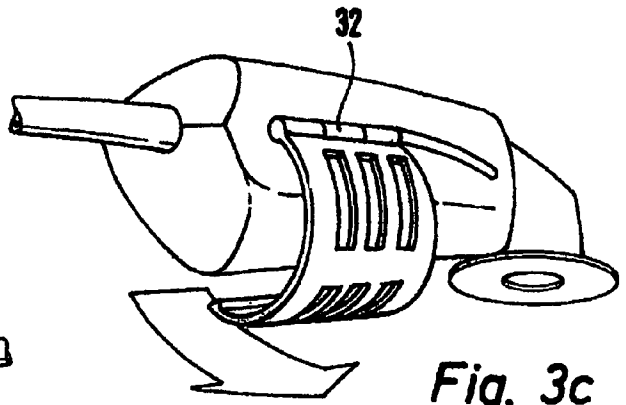
FIG. 3*c* is a third perspective view of the embodiment of FIG. 3*a*.
Figure 3A:
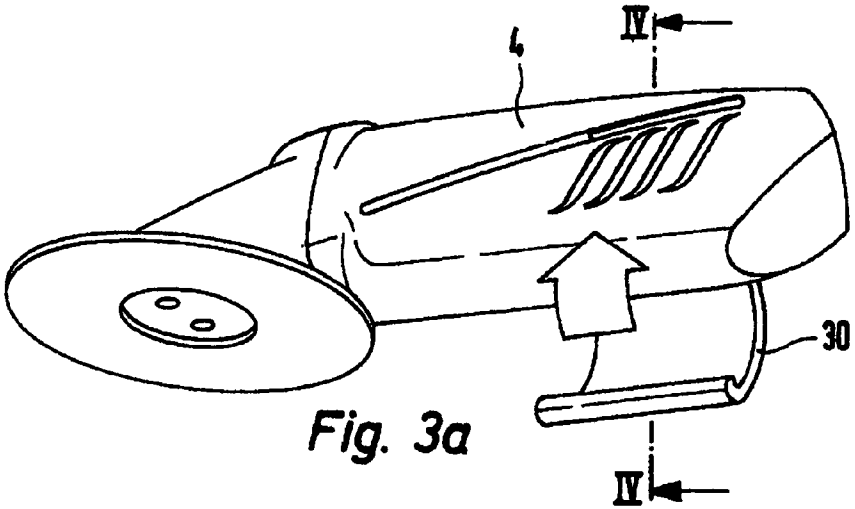
FIG. 3*a* is a first perspective view of a second embodiment of the inventive hand-held power tool.
Figure 3B:
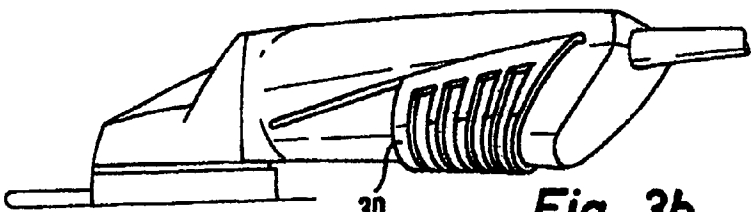
FIG. 3*b* is a second perspective view of the embodiment of FIG. 3*a;*

FIGS. 3*a* and 3*b* show a further preferred embodiment of the inventive hand-held power tool 2, wherein the filter retaining part 30 is provided in such a way that it can swing around a pivot axis 32 that is essentially parallel with a longitudinal axis of the housing. The filter retaining part 30 is again constituted in the shape of a shell. The pivoting mounting is provided at one end of its circumference and the other end of the circumference is constituted by a type of snap-in lug 24 as described above for the embodiment according to FIGS. 1*a* and 1*b*. The recess 22 is also constituted as in the first embodiment. Swinging open and swinging closed the filter retaining part 30 works as shown in FIGS. 3 and 4.

In this case, too, it proves advantageous if the filter retaining part 30 protrudes only a few millimeters beyond the exterior of the housing base 4 to avoid impeding handling of the hand-held power tool 2.

We claim:

1. A hand-held power tool of the type having electromotive drive components, said power tool comprising:

a housing base containing the electromotive drive components, said housing base having air inlet openings for admitting an air flow into said housing for cooling the electromotive drive components, said housing base having an exterior which includes at least one engagement element;

a filter element for filtering dust from said air flow; and an elastically deformable filter retaining part for releaseably retaining said filter element to said housing base such that the air flow passes through said filter, said filter retaining part being of an arcuate cross-section which terminates in a first end and a second end, said first end and said second end being spaced a distance from one another, at least one of said first end and said second end carrying an engagement lug which is detachably engageable with said engagement element such that said filter retaining part is elastically deformed when said engagement lug and said engagement element are in engagement with one another, said filter retaining part being so elastically deformed as a result of increasing said distance.

2. A hand-held power tool as claimed in claim 1, wherein said dust is magnetizable dust.

3. A hand-held power tool as claimed in claim 1, wherein said filter retaining part is expanded to increase said distance during attachment of said filter retaining part to said housing base.

4. A hand-held power tool as claimed in claim 1, wherein said air inlet openings are covered by said filter element.

5. A hand-held power tool as claimed in claim 1, wherein said engagement element comprises a slot-shaped, rounded recess.

6. A hand-held power tool as claimed in claim 1, wherein said filter retaining part is attached to said exterior of said housing base in a pivotable manner.

7. A hand-held power tool as claimed in claim 1, wherein said filter retaining part is constituted in a shape of a shell having openings.

8. A hand-held power tool as claimed in claim 1, wherein said filter retaining part has a said arcuate cross section which is an approximately circular arc with a circumferential length of more than one hundred eighty degrees.

* * * * *